US006924030B2

(12) United States Patent
Kamada

(10) Patent No.: US 6,924,030 B2
(45) Date of Patent: Aug. 2, 2005

(54) POLYVINYL ALCOHOL BINDER FIBERS, AND PAPER OR NONWOVEN FABRIC COMPRISING THEM

(75) Inventor: Hideki Kamada, Okayama (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 10/796,066

(22) Filed: Mar. 10, 2004

(65) Prior Publication Data

US 2004/0180198 A1 Sep. 16, 2004

(30) Foreign Application Priority Data

Mar. 10, 2003 (JP) ..... 2003-063205

(51) Int. Cl.[7] ..... D01F 6/00
(52) U.S. Cl. ..... 428/364; 428/394; 264/185
(58) Field of Search ..... 428/364, 394; 264/185; 162/146, 157.4

(56) References Cited

U.S. PATENT DOCUMENTS 6,346,570 B1 * 2/2002 Kazuyuki et al. ..... 524/783
6,569,525 B2 * 5/2003 Rieder et al. ..... 428/397
6,569,526 B2 * 5/2003 Rieder et al. ..... 428/397
6,783,852 B2 * 8/2004 Inada et al. ..... 428/364

* cited by examiner

*Primary Examiner*—N. Edwards
(74) *Attorney, Agent, or Firm*—Oblon, Spivak, McClelland, Maier & Neustadt, P.C.

(57) ABSTRACT

PVA binder fibers having the following characteristics: a cross-section circularity of at most 30%, a degree of swelling in water at 30° C. of at least 100%, and a degree of dissolution in water of at most 20%, are capable of being processed even under low-energy drying condition, for example, in high-speed drying in a hot air drying system (e.g., air-through drier) or in low-temperature drying in a multi-cylinder system or the like to give paper and nonwoven fabrics of high strength.

12 Claims, 1 Drawing Sheet

【Fig.1】
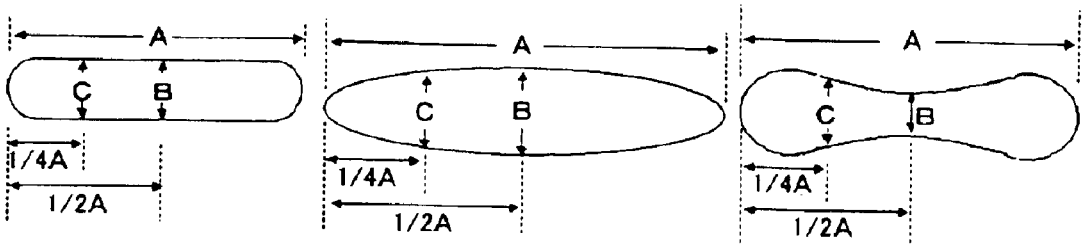

POLYVINYL ALCOHOL BINDER FIBERS, AND PAPER OR NONWOVEN FABRIC COMPRISING THEM

BACKGROUND OF THE INVENTION

1. Field of the Invention

The present invention relates to polyvinyl alcohol binder fibers capable of melting under low-energy drying condition and capable of giving paper and nonwoven fabrics of high strength. The present invention also relates to paper and nonwoven fabrics comprising the fibers.

2. Description of the Related Art

At present, polyvinyl alcohol (hereinafter abbreviated to PVA) fibers are used as binder fibers in papermaking, as they are soluble in water and their adhesiveness is high. The adhesiveness of PVA binder fibers is high, and this is because the fibers swell in water where they have dispersed in a step of papermaking from them, and may therefore well melt under heat in a step of drying them, and they crystallize while being dried.

Heretofore when PVA fibers are used in producing paper or nonwoven fabrics, a thermal drum-type Yankee drier is generally used in the step of drying them. The Yankee drier generates a large quantity of heat for drying, and therefore when PVA binder fibers are dried therein, they may well melt and express high adhesiveness. However, with the recent tendency in the art toward efficient drying and improved productivity, air-through driers and the like have become much used in many cases, but they are problematic in the following point. When air-through driers are driven for drying therein, they have a short drying time and generate a small quantity of drying heat, and therefore ordinary PVA binder fibers could not well melt while dried therein, and, as a result, the dried fibers could not express sufficient adhesiveness.

To solve the problem as above, various methods have been employed. For example, PVA resin having a low degree of saponification is used for the starting material; or an ionic functional group, for example, a cationic group such as carboxyl group, sulfonic acid group, silyl group or quaternary ammonium group is introduced into PVA resin to thereby improve the solubility of the resulting resin. Specifically, the degree of saponification of PVA resin is lowered so as to increase the solubility of the resin, and the degree of polymerization of PVA resin is lowered so as to increase the solubility of the resin, and various methods for these have been proposed (for example, refer to Patent References 1, 2). Another technique has also been proposed, which comprises introducing a silyl group or an ethylene group into PVA resin to thereby increase the solubility and the adhesiveness of the resin (for example, refer to Patent References 3, 4, 5, 6).

In JP-A 51-96533, JP-A 54-96534, JP-A 60-231816, JP-A 4-126818, JP-A 58-220806, and JP-A 2003-27328, modification of PVA resin is essentially investigated for attaining increased adhesiveness of binder fibers. In these, however, the binder fibers are produced through melt spinning or wet spinning through spinnerets with round orifices, and therefore, the cross-sectional profile of the fibers is roundish or cocoon-shaped, and the cross-section circularity of the fibers, which is calculated according to the calculation formula to give a cross-section circularity from a cross-section profile of fibers, is 35% or more. As a result, the binder fibers obtained in JP-A 51-96533, JP-A 54-96534, JP-A 60-231816, JP-A 4-126818, JP-A 58-220806, JP-A 2003-27328 are problematic in that, though they could be well adhesive when dried under high-energy drying condition such as a thermal drum-type Yankee drier system, they could not be well adhesive when dried in high-speed drying such as a hot air drying system or under low-temperature/low-energy drying condition such as in a multi-cylinder system.

SUMMARY OF THE INVENTION

It is an object of the present invention to provide polyvinyl alcohol binder fibers capable of melting under low-energy drying condition, for example, in high-speed drying in a hot air drying system or in low-temperature drying in a multi-cylinder system or the like, and capable of giving paper and nonwoven fabrics of high strength.

Another object is to provide paper and nonwoven fabrics comprising the above fibers.

This and other objects have been achieved by the present invention the first embodiment of which includes polyvinyl alcohol binder fibers having a cross-section circularity of at most 30%, a degree of swelling in water at 30° C. of at least 100%, and a degree of dissolution in water of at most 20%.

In another embodiment, the present invention relates to a paper or a nonwoven fabric, comprising:

from 1 to 50% by mass of the above polyvinyl alcohol binder fibers.

In another embodiment, the present invention relates to a method for producing the above polyvinyl alcohol binder fibers, comprising:

dissolving a polyvinyl alcohol resin in water to prepare a spinning solution having a polymer concentration of from 8 to 18% by mass, spinning said solution into fibers in a coagulation bath that contains an aqueous solution of a salt having the ability to coagulate the resin, drawing the fibers by 2 to 5 times in wet, and drying the fibers.

BRIEF DESCRIPTION OF THE DRAWING

FIG. 1 is a schematic view graphically showing various cross-sectional profiles of flattened fibers.

DETAILED DESCRIPTION OF THE INVENTION

Taking the above into consideration the present inventors have assiduously studied and, as a result, have found that, when a spinneret to give a cross-section circularity of at most 30% is used in spinning fibers having a flattened cross-section and therefore having an increased surface area, then the fibers may form paper and nonwoven fabrics of high strength even when they are dried under low-temperature and low-energy drying condition, not requiring a high-energy drying method such as the conventional thermal drum-type Yankee drier system. In addition, the present inventors have further found that the paper and nonwoven fabrics thus formed of the fibers realize efficient drying and improved productivity.

Specifically, the present invention provides PVA binder fibers having a cross-section circularity of at most 30%, a degree of swelling in water at 30° C. of at least 100%, and a degree of dissolution therein of at most 20%. The cross-section circularity includes all values and subvalues between 0 and 30%, especially including 2, 4, 6, 8, 10, 12, 14, 16, 18, 20, 22, 24, 26 and 28%. The degree of swelling is at least 100%, preferably at least 150%, more preferably at least 200% and most preferably at least 250%. The degree of dissolution includes all values and subvalues between 0 and 20%, especially including 2, 4, 6, 8, 10, 12, 14, 16 and 18%. Preferably, the PVA binder fibers have a flattened cross-sectional profile, and satisfy $A/B \geqq 3$ and $0.6 \leqq C/B \leqq 1.2$ where A indicates the length of the major side of the cross section, B indicates the thickness of the center (½ A) of the major side, and C indicates the thickness of the part of ¼ A from the end of the major side. More preferably, the thickness B of the center (½ A) of the major side of the cross section of the PVA binder fibers is at most 6 μm. The thickness B includes all values and subvalues between 0 and 6 μm, especially including 0.5, 1, 1.5, 2, 2.5, 3, 3.5, 4, 4.5, 5 and 5.5 μm. Even more preferably, the PVA resin for the PVA binder fibers is copolymerized with from 0.1 to 15 mol % of a compound having at least one of the following groups: a carboxylic acid group, a sulfonic acid group, an ethylene group, a silane group, a silanol group, an amine group and an ammonium group. The amount of comonomer includes all values and subvalues therebetween, especially including 0.5, 1.5, 2, 3, 4, 5, 6, 7, 8, 9, 10, 11, 12, 13 and 14 mol %. The present invention also provides paper and nonwoven fabrics comprising from 1 to 50% by mass of the PVA binder fibers. The amount of PVA binder fibers in the paper includes all values and subvalues therebetween, especially including 5, 10, 15, 20, 25, 30, 35, 40 and 45% by mass.

The PVA binder fibers of the present invention have a single-fiber cross-section circularity of at most 30% and have a degree of swelling in water at 30° C. of at least 100% and a degree of dissolution therein of at most 20%, and therefore the fibers can give paper and nonwoven fabrics of high strength even when dried in high-speed drying such as a hot air drying system or under low-energy drying condition in low-temperature drying such as a multi-cylinder system or the like.

DESCRIPTION OF THE PREFERRED EMBODIMENTS

The adhesiveness of PVA binder fibers is high, and this is because the fibers swell in water where they have dispersed in a step of papermaking from them, and may therefore well melt under heat in a step of drying them, and they crystallize while being dried. However, conventional PVA binder fibers could not well melt under low-energy drying condition, for example, in trendy high-speed drying or low-temperature drying, and therefore could not be highly adhesive when dried under such condition. In conventional techniques, the degree of saponification of PVA resin is lowered or a modified group is introduced into PVA resin to thereby lower the crystal size of the resin, as so mentioned hereinabove. This is for lowering the crystal-melting temperature of the resin as an index of the meltability of the resin. In contrast, the present invention is characterized in that the cross-section circularity of fibers is significantly lowered and the adhesive area thereof is increased so as to increase the strength of the paper and nonwoven fabrics that comprise the fibers.

The cross-sectional profile of the PVA binder fibers of the present invention must be so designed that the cross-section circularity of the fibers is at most 30%. Having the specifically designed cross-sectional profile that the cross-section circularity thereof is at most 30%, the PVA binder fibers of the present invention may therefore have an increased surface area. Accordingly, when the fibers are used in producing paper or nonwoven fabrics, then the paper and nonwoven fabrics produced may have high strength even if the fibers are dried under low-temperature and low-energy drying condition, as will be described below. Preferably, the cross-section circularity of the fibers is at most 27%, more preferably at most 25%. One preferred method for making the fibers to have a cross-section circularity of at most 30% is that the fibers are made to have a flattened cross section. Preferably, the fibers satisfy $A/B \geqq 3$ and $0.6 \leqq C/B \leqq 1.2$ as in FIG. 1, where A indicates the length of the major side of the flattened cross section, B indicates the thickness of the center (½ A) of the major side, and C indicates the thickness of the part of ¼ A from the end of the major side. If $A/B<3$, then the cross-section circularity of the fibers is larger than 30% and is unfavorable. If $C/B<0.6$ or $C/B>1.2$, then the fibers could not have the a flattened cross section that the fibers of the present invention are to have; and if so, the surface area of the binder fibers could not increase and the fibers could not express good binder effect. More preferably, $A/B \geqq 5$ and $0.8 \leqq C/B \leqq 1.2$; even more preferably $A/B \geqq 6$ and $0.9 \leqq C/B \leqq 1.1$. Also preferably, the thickness B is at most 6 μm, more preferably at most 5 μm for further enhancing the adhesiveness of the binder fibers.

The cross-section circularity and the cross-sectional profile of the fibers are determined by the use of a scanning electronic microscope.

The degree of swelling in water at 30° C. of the PVA binder fibers of the present invention must be at least 100%. If the degree of swelling thereof is smaller than 100%, then the fibers could not fully express the potency as binder. Preferably, it is at least 120%, more preferably at least 140%.

The PVA resin for use in the present invention is not specifically defined. For example, it may be low-saponification PVA, or PVA copolymerized with one or more compounds having one or more groups selected from a carboxyl acid group, a sulfonic acid group, an ethylene group, a silane group, a silanol group, an amine group and an ammonium group. Preferably, however, the PVA resin for use in the present invention is copolymerized with from 0.1 to 15 mol % of a compound having any of a carboxylic acid group, a sulfonic acid group, an ethylene group, a silane group, a silanol group, an amine group and an ammonium group. The PVA binder fibers of the present invention that are formed from the non-copolymerized PVA resin or the copolymerized PVA resin as above must satisfy the requirement that their dissolution in water at 30° C. is at most 20%. If their dissolution therein is over 20%, then the yield in producing paper or nonwoven fabrics from the fibers is low and therefore the cost of the fibrous products increases. If so, in addition, the fibers will much dissolve in white water (water used in papermaking) to increase the drainage load in papermaking, and, when the fibers are formed into paper, the dissolved PVA will re-adhere to it to worsen the paper quality (concretely, the paper feel will be rough and hard). Preferably, the fiber dissolution is at most 10%, more preferably at most 5%.

The degree of polymerization of the PVA resin for use in the present invention is preferably at least 300 in point of the dissolution of the PVA binder fibers formed of the resin, but preferably at most 3000 in point of the productivity and the cost of the resin. More preferably, it falls between 800 and 2000. The degree of dissolution includes all values and subvalues therebetween, especially including 400, 500, 600, 700, 800, 900, 1000, 1200, 1400, 1600, 1800, 2000, 2200, 2400, 2600 and 2800. The degree of saponification of PVA for use herein is preferably at least 95 mol % in point of the dissolution of PVA. If the degree of saponification thereof is smaller than 95 mol %, then PVA dissolves too much while the binder formed of it is used and therefore causes some problems in that the yield of the polymer is low and the polymer dissolves in exhaust water. If so, in addition, the water resistance of the binder formed of it is extremely low, and the binder potency is extremely poor in wet condition. More preferably, the degree of saponification of PVA falls between 96 and 99.9 mol %.

The PVA binder fibers of the present invention may be produced by dissolving the above-mentioned PVA resin in water to prepare a spinning solution having a polymer concentration of from 8 to 18% by mass, then spinning the stock into fibers in a coagulation bath that contains an aqueous solution of a salt having the ability to coagulate the resin, drawing the fibers by 2 to 5 times in wet, and drying them. The polymer concentration of the spinning solution includes all values and subvalues therebetween, especially including 9, 10, 11, 12, 13, 14, 15, 16 and 17% by mass. If the concentration of the PVA resin dissolved in water is higher than 18% by mass, then the viscosity of the resulting PVA polymer solution will be too high and the polymer solution could not be spun into fibers. Preferably, the polymer concentration falls between 10 and 16% by mass.

The salt having the ability to coagulate the resin includes, for example, sodium sulfate (Glauber's salt), ammonium sulfate and sodium carbonate. The fibers formed in the coagulation bath that contains an aqueous solution of the salt having the ability to coagulate the resin are directly drawn in wet. In this stage, if the wet draw ratio is smaller than 2 times, then the fibers could not be spun suitably. However, if the wet draw ratio is larger than 5 times, then the PVA molecules will be too much oriented and the crystal melting temperature of the resulting fibers will therefore increase. If so, the degree of swelling in water of the fibers thus obtained lowers and the fibers could not serve as binder.

The PVA binder fibers of the present invention that have a cross-section circularity of at most 30% are produced preferably as follows: The spinning solution for the fibers is spun out into an aqueous solution that contains a salt having the ability to coagulate the resin, through a spinneret with rectangular orifices of from 80 to 800 μm in width and from 20 to 80 μm in thickness, while the tension between the metal plate of the spinneret and the first roller is controlled to fall between 0.003 and 0.01 cN/dtex. If the tension is lower than 0.003 cN/dtex, the cross section of the fibers may deform to be cocoon-shaped and the fibers could not have the specific cross-sectional profile that the present invention is to attain. On the other hand, if the tension is higher than 0.01 cN/dtex, then the fibers may cut in the coagulation bath and good fibers could not be spun. More preferably, the tension falls between 0.0035 and 0.006 cN/dtex. The width of the rectangular orifices includes all values and subvalues therebetween, especially including 100, 150, 200, 250, 300, 350, 400, 450, 500, 550, 600, 650, 700 and 750 μ/m. The thickness of the rectangular orifices includes all values and subvalues therebetween, especially including 25, 30, 35, 40, 45, 50, 55, 60, 65, 70 and 75 μm. The tension between the metal plate of the spinneret and the first roller includes all values and subvalues therebetween, especially including 0.004, 0.005, 0.006, 0.007, 0.008 and 0.009 cN/dtex.

Though not specifically defined, the single-fiber mean fineness of the PVA binder fibers of the present invention preferably falls between 0.01 and 50 dtex. The single-fiber mean fineness of the PVA binder fibers includes all values and subvalues therebetween, especially including 0.05, 0.1, 0.5, 1, 2, 3, 4, 5, 10, 15, 20, 25, 30, 35, 40 and 45 dtex. If the mean fineness is smaller than 0.01 dtex, then the fibers will be difficult to produce and therefore the productivity of the fibers will lower and the production costs thereof will increase. On the other hand, if the mean fineness is larger than 50 dtex, then the fiber diameter of the single fibers increases and therefore the adhesiveness of the fibers will be poor. More preferably, the mean fineness falls between 0.1 and 5.0 dtex. The fibers of the present invention may be used in any form. For example, they may be cut fibers, filament yarns or spun yarns.

Paper and nonwoven fabrics are produced by the use of the PVA binder fibers of the present invention. Preferably, the content of the PVA binder fibers in the paper and nonwoven fabrics produced is from 1 to 50% by mass of the overall solid content of the fibrous products. The content of the PVA binder fibers in the paper includes all values and subvalues therebetween, especially including 5, 10, 15, 20, 25, 30, 35, 40 and 45% by mass. If the content of the PVA binder fibers in the paper and nonwoven fabrics produced is lower than 1% by mass, then the fibers could not act as binder since the number of the constitutive fibers in the fibrous products is small, and the fibers could not express adhesiveness. On the other hand, if the content of the PVA binder fibers in the paper and nonwoven fabrics produced is higher than 50% by mass, then it means that the binder fibers are the main ingredient of the fibrous products. If so, the shrinkage of the binder fibers in the fibrous products, paper and nonwoven fabrics may lower the surface smoothness of the fibrous products and roughen the feel thereof, or that is, it may worsen the quality of the fibrous products. More preferably, the content of the PVA binder fibers falls between 2 and 30% by mass, even more preferably between 5 and 25% by mass.

Having generally described this invention, a further understanding can be obtained by reference to certain specific examples which are provided herein for purposes of illustration only, and are not intended to be limiting unless otherwise specified.

EXAMPLES

In the following Examples, the degree of polymerization of the PVA resin; the cross-section circularity, the cross-sectional profile, the degree of dissolution and the degree of swelling of the PVA binder fibers; and the wet breaking length (WB) and the dry breaking length (DB) of the paper produced by the use of the PVA binder fibers were measured according to the methods described below.

Degree of Polymerization of PVA Resin:

A PVA polymer is dissolved in hot water to have a polymer concentration of from 1 to 10 g/liter (Cv), and the relative viscosity ηrel of resulting polymer solution is measured at 30□C according to the test method of JIS K6726. The intrinsic viscosity [η] of the polymer is obtained according to the following formula (1), and the degree of polymerization PA thereof is calculated according to the following formula (2).

$$[\eta]=2.303\cdot\log(\eta rel)/Cv \quad (1),$$

$$PA=([\eta]\times 104/8.29)\times 1.613 \quad (2).$$

Cross-Section Circularity of PVA Binder Fibers, %:

Using a scanning electronic microscope (by Hitachi), the fibers are analyzed for the cross-sectional profile thereof. The cross-section area S1 of one fiber, and the minimum circle area S2 that surrounds the fiber are measured. The cross-section circularity of the fibers is obtained according to the following formula:

$$\text{Cross-Section Circularity } (\%)=(S1/S2)\times 100.$$

Cross-Sectional Profile of PVA Binder Fibers,A/B,C/B,B (μm):

Using a scanning electronic microscope (by Hitachi), the fibers are analyzed for the cross-sectional profile thereof.

PVA Dissolution from PVA Binder Fibers, %:

The fibers are sampled to prepare a sample thereof having a pure PVA resin content of 1 g, and it is dipped in 100 ml of water at 30° C. and statically kept therein for 30 minutes still at 30° C. After thus kept, the insoluble part is removed and 50 ml of the supernatant is collected. This is evaporated on a steam bath to dryness, and then further dried in a drier at 105° C. for 4 hours. After thus dried, the dried residue a (g) is weighed. The dried residue contains PVA and inorganic matter such as sodium sulfate, and it is fired at 500 to 800° C. until the PVA component is completely removed. After thus fired, the residue b (g) is weighed. The PVA dissolution is obtained according to the following formula:

$$\text{PVA Dissolution } (\%)=(a-b)\times 200.$$

Degree of Swelling of PVA Binder Fibers, %:

The fibers are sampled to prepare a sample thereof having a pure PVA resin content of 1 g, and it is dipped in 100 ml of water at 30° C. and statically kept therein for 30 minutes still at 30° C. After thus kept, the fibers are taken out through filtration and dewatered in a centrifugal dewatering machine at 3000 rpm for 10 minutes, and the mass of the dewatered fibers (M1) is measured. After its mass has been measured, the sample is dried in a hot air drier at 105° C. for 4 hours, and its mass (M2) is again measured. The degree of swelling of the fibers is obtained according to the following formula:

$$\text{Degree of Swelling } (\%)=[(M1-M2)/M2]\times 100.$$

Wet Breaking Length WB, Dry Breaking Length DB, N·m/g:

The paper is dipped in water at 20° C. for 24 hours to thereby make it absorb water, and this is then cut into a sample having a width of 15 mm and a length of 170 mm. The wet strength WS (N) of the sample is measured at a pulling rate of 50 mm/min. The sample holding length is 100 mm. The wet breaking length WB of the paper is obtained according to the following formula, in which W (g/m2) indicates the weight of the sample.

$$WB=WS/(15\times W)\times 1000\ (N\cdot m/g).$$

On the other hand, the dry breaking strength DB of the paper is as follows: The paper is conditioned in a room at 23° C. and 50% RH for 24 hours, and then cut into a sample having a width of 15 mm and a length of 170 mm. The dry strength DS (N) of the sample is measured at a pulling rate of 50 mm/min. The sample holding length is 100 mm. The dry breaking length WB of the paper is obtained according to the following formula, in which W ($g/m^2$) indicates the weight of the sample.

$$DB=DS/(15\times W)\times 1000\ (N\cdot m/g).$$

Example 1

(1) An aqueous spinning solution of 14% by mass of PVA resin having a mean degree of polymerization of 1700 and a degree of saponification of 98.0 mol % was spun out into a coagulation bath of saturated sodium sulfate, through a spinneret with 4000 rectangular slit orifices of 30 μm (length)×180 μm (width), and the resulting fibers were wound up around a first roller under a tension of from 0.035 to 0.045 N/dtex between the metal plate of the spinneret and the first roller, and drawn in wet by 4 times. Then, these were dried in a constant-length drier at 120° C. for 10 minutes to be flattened PVA fibers having a cross-section circularity of 23%, and a cross-sectional profile, A/B=6.3, C/B=0.97 and B=4.5 μm, and having a fineness of 1.5 dtex, as in Table 1. Thus obtained, the degree of swelling of the flattened PVA fibers was 182%, and the degree of PVA dissolution thereof was 6.9%.

(2) The PVA fibers obtained in the above (1) were cut into 3-mm pieces. 20 parts by mass of the fibers in terms of the pure fiber content, and 80 parts by mass of glass fibers ("GP024" by Asahi Fiber Glass, having a fiber diameter of 9 μm and a fiber length of 6 mm) were uniformly mixed and stirred to prepare a slurry. The resulting slurry was fed into a TAPPI papermaking machine and formed into paper. This was dried on a net-type air-through drier at a drying temperature of 210° C., and the paper thus obtained had a weight of 40 g/m2. DB and WB of the paper were 4.59 N·m/g and 0.34 N·m/g, respectively, as in Table 1.

Example 2

(1) An aqueous spinning solution of 14% by mass of PVA resin having a mean degree of polymerization of 1700, a degree of saponification of 98.0 mol % and an ethylene content of 5 mol % was spun, drawn and heat-treated under the same condition as in Example 1 to obtain flattened PVA fibers having a cross-section circularity of 23%, and a cross-sectional profile, A/B=6.1, C/B=0.97 and B=4.5 μm, and having a fineness of 1.5 dtex, as in Table 1. The degree of swelling of the flattened PVA fibers was 154%, and the degree of PVA dissolution thereof was 2.3%.

(2) The PVA fibers obtained in the above (1) were formed into paper under the same condition as in Example 1. DB and WB of the paper were 4.63 N·m/g and 0.78 N·m/g, respectively, as in Table 1.

Example 3

(1) An aqueous spinning solution of 14% by mass of PVA resin having a mean degree of polymerization of 1700 and a degree of saponification of 99.9 mol % was spun, drawn and heat-treated under the same condition as in Example 1 to obtain flattened PVA fibers having a cross-section circularity of 23%, and a cross-sectional profile, A/B=6.2, C/B=0.99 and B=4.4 μm, and having a fineness of 1.5 dtex, as in Table 1. The degree of swelling of the flattened PVA fibers was 143%, and the degree of PVA dissolution thereof was 0.9%.

(2) The PVA fibers obtained in the above (1) were formed into paper under the same condition as in Example 1. DB and WB of the paper were 2.80 N·m/g and 0.38 N·m/g, respectively, as in Table 1.

Example 4

(1) An aqueous spinning solution of 14% by mass of PVA resin having a mean degree of polymerization of 1700 and a degree of saponification of 98.0 mol % was spun out into a coagulation bath of saturated sodium sulfate, through a spinneret with 4000 rectangular slit orifices of 30 μm (length)×450 μm (width), and the resulting fibers were wound up around a first roller under a tension of from 0.035 to 0.045 cN/dtex between the metal plate of the spinneret and the first roller, and drawn in wet by 4 times. Then, these were dried in a constant-length drier at 120° C. for 10 minutes to be flattened PVA fibers having a cross-section circularity of 9%, and a cross-sectional profile, A/B=16, C/B=0.98 and B=4.5 μm, and having a fineness of 3.8 dtex, as in Table 1. Thus obtained, the degree of swelling of the flattened PVA fibers was 162%, and the degree of PVA dissolution thereof was 3.1%.

(2) The PVA fibers obtained in the above (1) were formed into paper under the same condition as in Example 1. DB and WB of the paper were 4.48 N·m/g and 0.35 N·m/g, respectively, as in Table 1.

Example 5

(1) An aqueous spinning solution of 14% by mass of PVA resin having a mean degree of polymerization of 1700 and a degree of saponification of 98.0 mol % was spun and drawn in wet under the same condition as in Example 1, then washed in water at 15 to 30° C. under a constant length condition, and thereafter dried in a constant-length drier at 120° C. for 10 minutes to obtain salt-free, flattened PVA fibers having a cross-section circularity of 23%, and a cross-sectional profile, A/B=6.1, C/B=0.97 and B=4.4 μm, and having a fineness of 1.5 dtex, as in Table 1. The degree of swelling of the flattened PVA fibers was 160%, and the degree of PVA dissolution thereof was 1.1%.

(2) The PVA fibers obtained in the above (1) were formed into paper under the same condition as in Example 1. DB and WB of the paper were 4.22 N·m/g and 0.33 N·m/g, respectively, as in Table 1.

Example 6

(1) A spinning solution with DMSO (dimethylsulfoxide) of 18% by mass of PVA resin having a mean degree of polymerization of 1700 and a degree of saponification of 98.0 mol % was spun out into a coagulation bath of methanol, through a spinneret with 20000 rectangular slit orifices of 30 μm (length)×180 μm (width), and the resulting fibers were wound up around a first roller under a tension of from 0.035 to 0.045 cN/dtex between the metal plate of the spinneret and the first roller, and drawn in wet by 3 times. Then, these were dried in a constant-length drier at 140° C. for 10 minutes to be salt-free, flattened PVA fibers having a cross-section circularity of 25%, and a cross-sectional profile, A/B=5.5, C/B=0.95 and B=4.7 μm, and having a fineness of 2.2 dtex, as in Table 1. Thus obtained, the degree of swelling of the flattened PVA fibers was 170%, and the degree of PVA dissolution thereof was 3.3%.

(2) The PVA fibers obtained in the above (1) were formed into paper under the same condition as in Example 1. DB and WB of the paper were 4.32 N·m/g and 0.34 N·m/g, respectively, as in Table 1.

Comparative Example 1

(1) An aqueous spinning solution of 14% by mass of PVA resin having a mean degree of polymerization of 1700 and a degree of saponification of 99.9 mol % was spun out into a coagulation bath of saturated sodium sulfate, through a spinneret with 4000 circular orifices of 60 μm in diameter, and the resulting fibers were wound up around a first roller, and drawn in wet by 4 times. Then, these were dried in a constant-length drier at 120° C. for 10 minutes to be cocoon-shaped PVA fibers having a cross-section circularity of 39%, and having a fineness of 1.0 dtex, as in Table 1. Thus obtained, the degree of swelling of the cocoon-shaped PVA fibers was 145%, and the degree of PVA dissolution thereof was 1.0%.

(2) The PVA fibers obtained in the above (1) were formed into paper under the same condition as in Example 1. DB and WB of the paper were 0.35 N·m/g and 0.05 N·m/g, respectively, as in Table 1. The strength of the paper obtained herein was much lower than that of the paper formed by the use of the PVA binder fibers of the present invention (Examples 1 to 6).

Comparative Example 2

(1) An aqueous spinning solution of 14% by mass of PVA resin having a mean degree of polymerization of 1700 and a degree of saponification of 98.0 mol % was spun, drawn and heat-treated under the same condition as in Comparative Example 1 to obtain cocoon-shaped PVA fibers having a cross-section circularity of 39%, and having a fineness of 1.0 dtex, as in Table 1. The degree of swelling of the cocoon-shaped PVA fibers was 162%, and the degree of PVA dissolution thereof was 3.1%.

(2) The PVA fibers obtained in the above (1) were formed into paper under the same condition as in Example 1. DB and WB of the paper were 1.52 N·m/g and 0.29 N·m/g, respectively, as in Table 1. The strength of the paper obtained herein was lower than that of the paper formed by the use of the PVA binder fibers of the present invention (Examples 1 to 6).

Comparative Example 3

In producing paper, herein used were PVA binder fibers of Nichibi's Solvron "NL 2003" having a cross-section circularity of 43% and having a dumbbell-shaped cross-sectional profile, A/B=3.7, C/B=1.4 and B=7.1 μm. As in Table 1, the degree of swelling of the binder fibers was 160%, and the PVA dissolution thereof was 10%. DB and WB of the paper were 1.81 N·m/g and 0.01 N·m/g, respectively. The strength of the paper obtained herein was much lower than that of the paper formed by the use of the PVA binder fibers of the present invention (Examples 1 to 6).

TABLE 1

| | Cross-section Circularity (%) | A/B | C/B | B (μm) | Degree of Swelling (%) | Degree of Dissolution (%) | DB (N · m/g) | WB (N · m/g) |
|---|---|---|---|---|---|---|---|---|
| Example 1 | 23 | 6.3 | 0.97 | 4.5 | 182 | 6.9 | 4.59 | 0.34 |
| Example 2 | 23 | 6.1 | 0.97 | 4.5 | 154 | 2.3 | 4.63 | 0.78 |
| Example 3 | 23 | 6.2 | 0.99 | 4.4 | 143 | 0.9 | 2.80 | 0.38 |
| Example 4 | 9 | 16 | 0.98 | 4.5 | 162 | 3.1 | 4.48 | 0.35 |
| Example 5 | 23 | 6.1 | 0.97 | 4.4 | 160 | 1.1 | 4.22 | 0.33 |
| Example 6 | 25 | 5.5 | 0.95 | 4.7 | 170 | 3.3 | 4.32 | 0.34 |

TABLE 1-continued

| | Cross-section Circularity (%) | A/B | C/B | B (μm) | Degree of Swelling (%) | Degree of Dissolution (%) | DB (N · m/g) | WB (N · m/g) |
|---|---|---|---|---|---|---|---|---|
| Comparative Example 1 | 39*1 | — | — | — | 145 | 1.0 | 0.35 | 0.05 |
| Comparative Example 2 | 39*1 | — | — | — | 162 | 3.1 | 1.52 | 0.29 |
| Comparative Example 3 | 43*2 | 3.7 | 1.4 | 7.1 | 160 | 10 | 1.81 | 0.01 |

*1cocoon-shaped cross section
*2dumbell-shaped cross section

The PVA binder fibers of the present invention have a single-fiber cross-section circularity of at most 30%, a degree of swelling in water at 30° C. of at least 100% and a degree of dissolution therein of at most 20%, and these can be processed even under low-energy drying condition, for example, in high-speed drying in a hot air drying system or in low-temperature drying in a multi-cylinder system or the like to give paper and nonwoven fabrics of high strength.

Japanese patent application 63,205/2003 filed Mar. 10, 2003, is incorporated herein by reference.

Numerous modifications and variations on the present invention are possible in light of the above teachings. It is therefore to be understood that within the scope of the appended claims, the invention may be practiced otherwise than as specifically described herein.

What is claimed is:

1. Polyvinyl alcohol binder fibers having a cross-section circularity of at most 30%, a degree of swelling in water at 30° C. of at least 100%, and a degree of dissolution in water of at most 20%.

2. Polyvinyl alcohol binder fibers as claimed in claim 1, which have a flattened cross-sectional profile, and satisfy $A/B \geqq 3$ and $0.6 \leqq C/B \leqq 1.2$;

wherein

A indicates the length of the major side of the cross section,

B indicates the thickness of the center (½A) of the major side, and

C indicates the thickness of the part of ¼A from the end of the major side.

3. Polyvinyl alcohol binder fibers as claimed in claim 2, wherein the thickness B of the center (½A) of the major side of the cross section is at most 6 μm.

4. Polyvinyl alcohol binder fibers as claimed in claim 1, wherein the polyvinyl alcohol resin is copolymerized with from 0.1 to 15 mol % of one or more compounds having one or more groups selected from the group consisting of a carboxylic acid group, a sulfonic acid group, an ethylene group, a silane group, a silanol group, an amine group and an ammonium group.

5. Polyvinyl alcohol binder fibers as claimed in claim 1, wherein the single-fiber mean fineness of the fibers is 0.01 to 50 dtex.

6. A paper or a nonwoven fabric, comprising:

from 1 to 50% by mass of the polyvinyl alcohol binder fibers of claim 1.

7. The paper or nonwoven fabric as claimed in claim 6, which have a flattened cross-sectional profile, and satisfy $A/B \geqq 3$ and $0.6 \leqq C/B \leqq 1.2$;

wherein

A indicates the length of the major side of the cross section,

B indicates the thickness of the center (½A) of the major side, and

C indicates the thickness of the part of ¼A from the end of the major side.

8. The paper or nonwoven fabric as claimed in claim 7, wherein the thickness B of the center (½A) of the major side of the cross section is at most 6 μm.

9. The paper or nonwoven fabric as claimed in claim 6, wherein the polyvinyl alcohol resin is copolymerized with from 0.1 to 15 mol % of one or more compounds having one or more groups selected from the group consisting of a carboxylic acid group, a sulfonic acid group, an ethylene group, a silane group, a silanol group, an amine group and an ammonium group.

10. The paper or nonwoven fabric as claimed in claim 6, wherein the single-fiber mean fineness of the fibers is 0.01 to 50 dtex.

11. A method for producing the polyvinyl alcohol binder fibers as claimed in claim 1, comprising:

dissolving a polyvinyl alcohol resin in water to prepare a spinning solution having a polymer concentration of from 8 to 18% by mass, spinning said solution into fibers in a coagulation bath that contains an aqueous solution of a salt having the ability to coagulate the resin, drawing the fibers by 2 to 5 times in wet, and drying the fibers.

12. The method as claimed in claim 11, wherein said salt having the ability to coagulate the resin is sodium sulfate, ammonium sulfate or sodium carbonate.

* * * * *